US005670983A

United States Patent [19]

Suboh et al.

[11] Patent Number: 5,670,983

[45] Date of Patent: Sep. 23, 1997

[54] VIDEO CONTROLLER WITH SHARED CONFIGURATION PINS

[75] Inventors: Abdel Hamid Suboh, Houston; Patrick A. Harkin, Spring; Stuart Hecht, Houston, all of Tex.

[73] Assignee: Compaq Computer Corporation, Houston, Tex.

[21] Appl. No.: 332,345

[22] Filed: Oct. 31, 1994

[51] Int. Cl.[6] ..... G09G 5/00

[52] U.S. Cl. ..... 345/132; 345/112

[58] Field of Search ..... 345/154, 132, 345/204, 3, 112, 185, 197, 198, 200, 155; 395/500

[56] References Cited

U.S. PATENT DOCUMENTS

Re. 33,916 5/1992 Saenz et al. ..... 345/132

4,928,306 5/1990 Biswas et al. .

5,325,109 6/1994 Duckworth ..... 345/132

*Primary Examiner*—Richard Hjerpe

*Assistant Examiner*—Regina Liang

*Attorney, Agent, or Firm*—Vinson & Elkins L.L.P.

[57] ABSTRACT

A video controller has one or more shared pins coupled to respective configuration signals. The shared pins are also coupled to other devices external to the video controller. Responsive to a reset signal, the configuration signals are stored in a configuration register. At other times, the external devices can overcome the configuration signals such that the shared pins may be used for other operations of the video subsystem.

19 Claims, 3 Drawing Sheets

VIDEO CONTROLLER WITH SHARED CONFIGURATION PINS

TECHNICAL FIELD OF THE INVENTION

This invention relates in general to computer video systems, and more particularly to a video controller with shared pins to receive both configuration signals and signals from other devices.

BACKGROUND OF THE INVENTION

Video subsystems for use in a computer are generally built around a video controller chip which performs most of the logic and control associated with the video subsystem. An exemplary embodiment of a video subsystem is shown in FIGS. 1*a* and 1*b*. The video subsystem 10 includes a video controller integrated circuit 12 (hereinafter, "video controller 12") coupled to a ROM (read-only memory) 14, VRAM (video random access memory) 16, VDAC (video digital-to-analog converter) 18 and PLL (phase-locked loop) 20. The VDAC 18 is coupled to the VRAM 16 and PLL 20. The video controller 12 outputs bus interface signals 22 to the system bus. The bus interface signals include ADDRESS, DATA, and CONTROL signals. FIG. 1*b* shows a more detailed view of the connection of the configuration signals to the video controller 12. Each node (C0–C7) for receiving a configuration signal is tied to either a logical high voltage or logical low voltage through a pull-up or pull-down resistor, respectively. Typically, information from the configuration signals is stored in a configuration register 23.

Development of the video controller 12 is a significant undertaking. Accordingly, the video controller 12 is typically designed to work with a variety of bus types. For example, it is common for a video controller chip to work with ISA (industry standard architecture), VESA (video electronics standard architecture) local bus, and PCI (peripheral component interface) local bus systems. The operation of the video controller 12 will vary depending upon the bus to which it is connected. In order to identify the bus, pins of the video controller chip are hard-wired to configuration signals which identify the bus to which the chip is connected. For example, a graphics controller board using a video controller designed to work with both VESA and PCI local bus systems would dedicate at least one pin of the video controller 12 to identify the bus type associated with the board. On a PCI board, the pin may be tied to a logical high voltage (e.g., 5 volts), while on a board designed to work in a VESA local bus, the pin would be tied to a logical low voltage (e.g., 0 volts).

In the situation described above, the configuration signal is determined during design of the video subsystem 10. There are other configuration signals, such as clock speeds and memory sizes, which may also be determined during the design of the board. Other configuration signals may be variable. For example, if a memory upgrade is an option for the video subsystem 10, then the configuration signal for the VRAM memory size may be varied either by a jumper on the video subsystem or through a device which automatically detects the memory size (or other configuration information).

In the prior art, each configuration signal necessitated a corresponding pin on the video controller 12. Accordingly, a large number of the video controller's pins would be consumed solely for configuration signals. So long as the chip carrier used for the video controller chip, such as PGA (pin grid array), BGA (ball grid array), or DIP (dual in-line package), has available pins, the number of configuration signals is not a problem. However, if the number of configuration signals requires the video controller designer to move up to a larger package size, the cost of the video controller chip can be significantly increased. The cost between successive sizes of BGA packages, for example, may exceed $1.00. With typical video board quantities in the millions, it can be seen that an appreciable amount of money can be saved by using a smaller package size.

Therefore, a need has arisen in the industry to provide a method and apparatus for providing configuration signals to a video controller, or other, integrated circuit, without increasing the package size of such integrated circuit.

SUMMARY OF THE INVENTION

In the present invention, a control system comprises an integrated control circuit having a configuration memory for storing configuration data. One or more nodes are coupled to both the configuration memory and to other devices internal to the integrated control circuit. First and second voltage sources are coupled to the nodes through associated resistive devices for providing configuration data. One or more devices external to the integrated controller circuit are also coupled to the nodes for driving the internal devices.

The present invention provides significant advantages over the prior art. In particular, nodes used for receiving configuration data may also be used for receiving signals from other devices external to the integrated controller circuit. Thus, additional pins are not needed for the configuration signals coupled to the shared nodes, thereby reducing the pin count of the integrated control circuit.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

The preferred embodiment of the present invention and its advantages are best understood by referring to FIGS. 2–5 of the drawings, like numerals being used for like and corresponding parts of the various drawings.

Figure 1A:
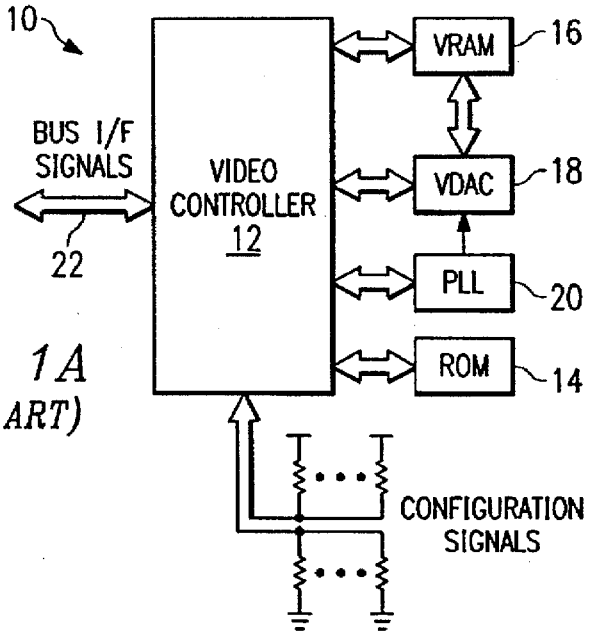
FIG. 1A (PRIOR ART)
FIG. 1*a* illustrates a block diagram of a prior art video subsystem.
Figure 1B:
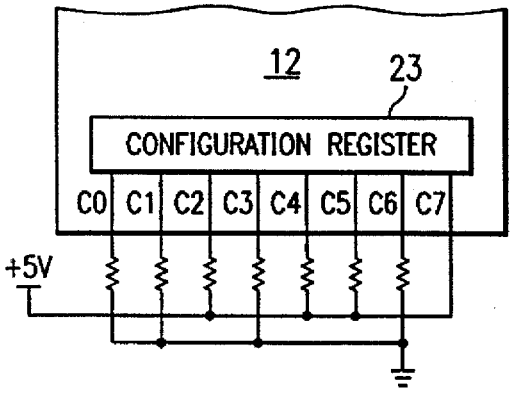
FIG. 1B (PRIOR ART)
FIG. 1*b* illustrates a schematic representation of the connection of configuration signals to a configuration register on the prior art video controller of FIG. 1*a;*
Figure 2:
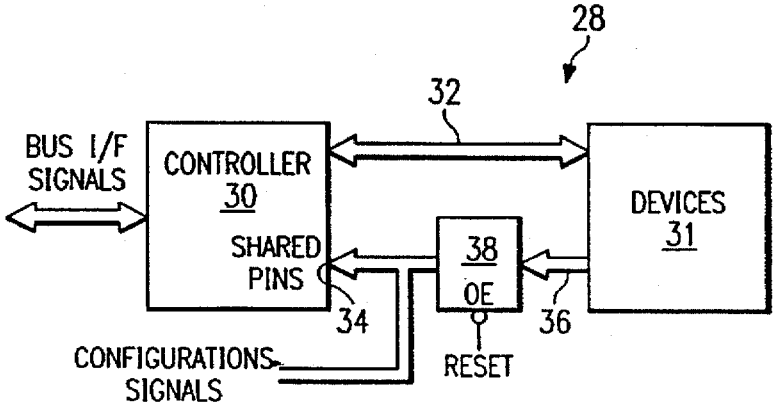
FIG. 2 illustrates a block diagram of the control system of the present invention.

FIG. 2 illustrates a block diagram of the control system 28 of the present invention. The invention will be described in connection with a video subsystem, it being understood that the invention can be used with various control systems and different architectures as those specifically set forth herein. In FIG. 2, the video controller 30 is coupled to devices, shown generally as block 31, through dedicated nodes 32 and shared nodes 34. The devices included in block 31 could be, for example, the ROM, VRAM, VDAC and PLL. Some outputs 36 of devices 31 are input to a buffer 38. The output enable port of the buffer 38 is coupled to the reset signal such that when reset is a logical high (indicating a reset condition), the buffer 38 will enter a high impedance state. The outputs of the buffer 38 are coupled to the controller 30 in parallel with respective configuration signals, such that each of the shared nodes 34 receive both a configuration signal and an output from the buffer 38. It should be noted that the buffer could be part of one of the devices in block 31, such as a tristate output of a multiplexer.

Figure 3:
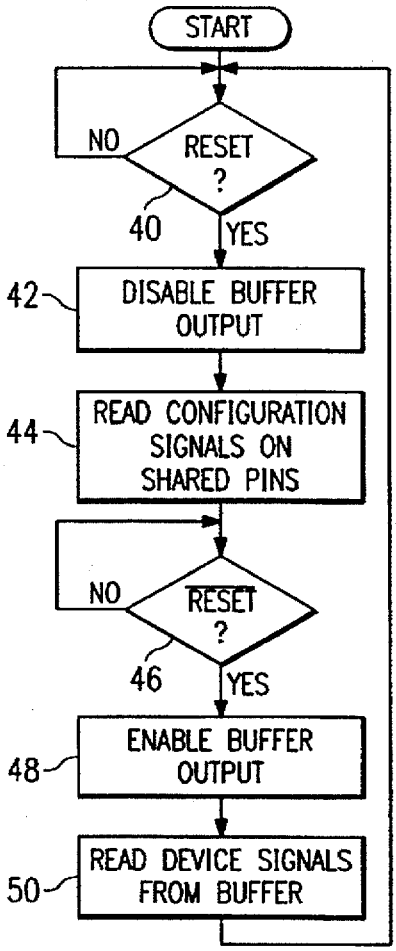
FIG. 3 illustrates a flow chart describing operation of the control system of FIG. 2.

The flow chart of FIG. 3 describes the operation of the control system 28. Responsive to a reset condition in decision block 40, the outputs of the buffer 38 are disabled (i.e, a high impedance state is entered) in block 42 and data from the configuration signals is read from the shared pins 34 into one or more configuration memories (block 44) on the falling edge of the reset signal. When the reset condition is finished in decision block 46, the outputs of the buffer are enabled (block 48), thereby passing the outputs 36 from the devices 31 to the shared pins 34. Because the configuration signals are weak relative to outputs 36 of the devices 31, the configuration signals will be easily overcome by the buffer's outputs and devices internal to the controller 30 may easily read the output of buffer 38. Similarly, the controller 30 could output data to the devices 31 by overcoming the configuration signals.

Figure 4:
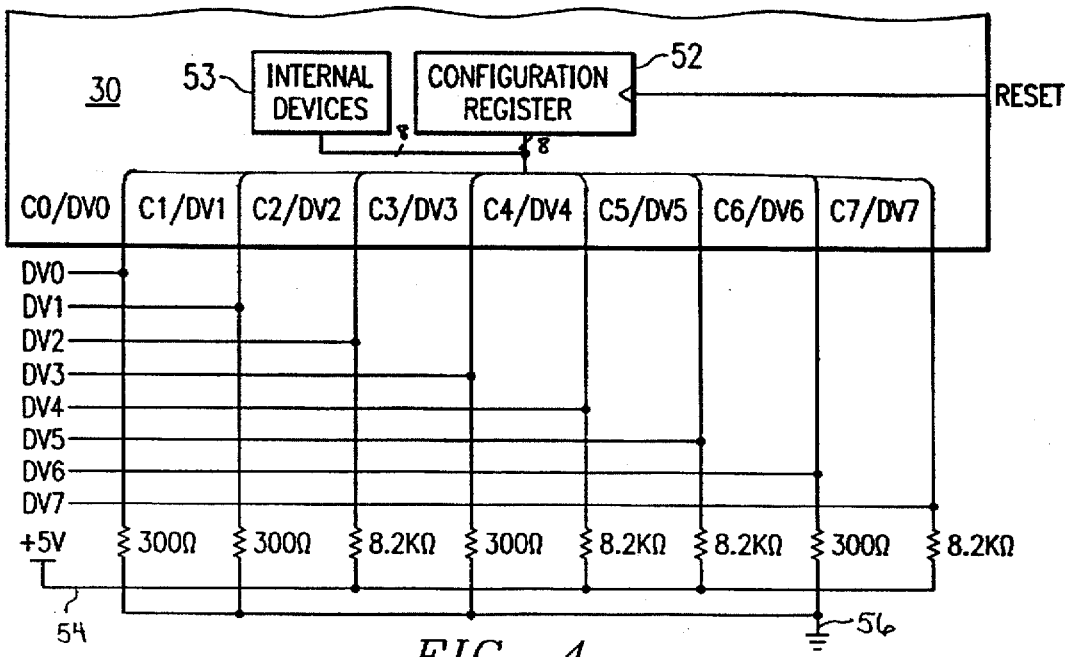
FIG. 4 illustrates a schematic representation of the shared configuration nodes of FIG. 2.

FIG. 4 illustrates a schematic representation of the connections between the controller 30 and the configuration signals and buffer outputs. As shown, the controller 30 has eight shared nodes shown as C0/DV0 through C7/DV7. The shared nodes are coupled to configuration memory (shown as register 52) and to other internal devices 53 of the controller 30. Configuration register 52 may be a single register, or multiple configuration registers. The internal devices may include, for example, other memories, state machine and combinational logic. Configuration register 52 is coupled to the reset signal. The outputs of buffer 31 are shown as DV0–DV7. The configuration signals are provided through five volt voltage sources 54, providing a high logic level, and ground 56 providing a low Logic level. While the logic levels are shown as 5 volts and ground, respectively, it should be noted that other voltages could be used as appropriate. The voltage sources 54 and 56 are coupled to the shared pins C0/DV0 through C7/DV7 via pull-up or pull-down resistors. In the preferred embodiment, an 8.2 km resistor is used to coupled the 5 volt source to the shared pins, while a 300 ohm resistor is used to coupled the ground to the pins. The purpose of the resistors is to allow the appropriate voltage to develop at the shared pins during the reset signal, and specifically, before a falling edge of the reset signal. However, the resistors allow the devices 31 to easily overcome the signals from the voltage sources 54 and 56 while the reset signal is disabled. While FIG. 4 shows all configuration signals originating from the high and low voltage sources, other devices may provide the configuration data on the shared nodes.

Figure 5:
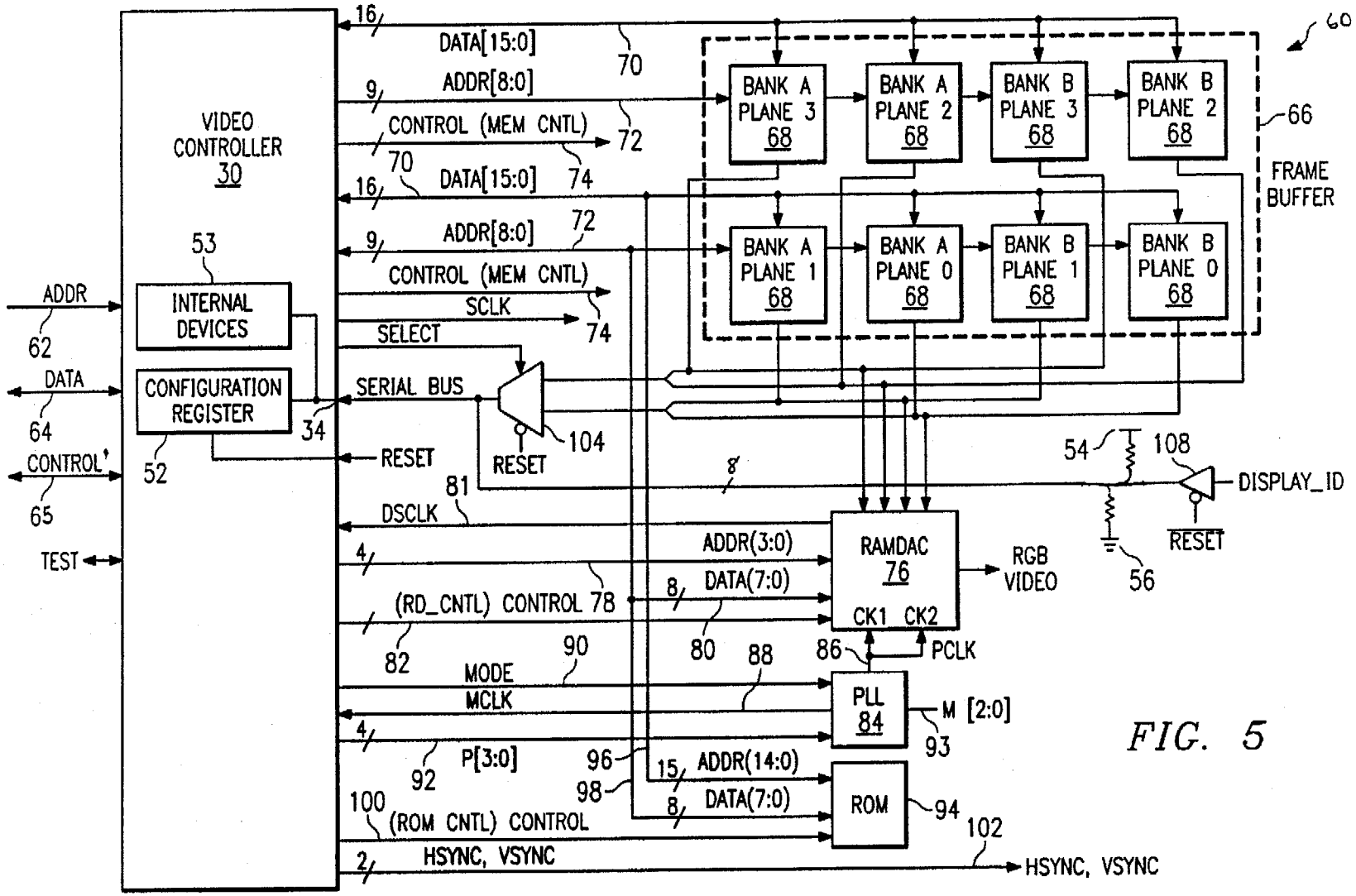
FIG. 5 illustrates a block diagram of an exemplary graphics controller architecture using the present invention.

FIG. 5 illustrates a block diagram of a video subsystem 60 using the present invention. In order to more clearly illustrate the invention, signals which are unnecessary to describe the general operation of the video subsystem 60 have been condensed or eliminated. Control of the video subsystem 60 is provided by video controller 30. The video controller 30 is coupled to the system bus through ADDR lines 62, DATA lines 64 and CONTROL lines 65. The video controller 30 is also coupled to a frame buffer 66 comprising a plurality of VRAM circuits 68 organized in two banks (bank A and bank B). A VRAM comprises a DRAM whose output is directed to a shift register. The video controller 30 is coupled to the frame buffer 66 via DATA lines 70, ADDR lines 72, SCLK 73 and CONTROL lines 74. The output of the frame buffer 66 is coupled to a RAMDAC (or VDAC) 76 which produces the RGB video output to the computer's display. The RAMDAC 76 is coupled to the video controller 30 via ADDR lines 78, DATA lines 80, DSCLK 81, and CONTROL lines 82. A phase lock loop circuit 84 (or other clock circuit) outputs a pixel clock (PCLK) 86 to the RAMDAC 76. The PLL 84 also generates a memory clock (MCLK) 88, which is output from the PLL 89 to the video controller 30. The PCLK controls the output of pixels from the RAMDAC 76 to the display, while the MCLK controls the video controller 30.

The video controller 30 controls the PLL 84 using the MODE lines 90, P lines 92 and M lines 93. This aspect of the invention is discussed in greater detail in connection with U.S. Patent application Ser. No. 08/191,311 to Suboh, filed Jan. 27, 1994, entitled "Video Subsystem Power Management Apparatus and Method", now issued into U.S. Pat. No. 5,524,249, which is incorporated by reference herein. When used as a card, rather than integrated on the system motherboard, a ROM 94 performs initiation functions. The ROM 94 is coupled to the video controller 30 through ADDR lines 96, DATA lines 98 and CONTROL lines 100. The video controller 30 also outputs HSYNC and VSYNC signals to the display on lines 102.

Configuration signals are received by the video controller 30 through shared pins 34. The output of multiplexer 104 is also coupled to shared pins 34. Shared pins 34 are coupled to configuration register 52 and other internal devices 53. The RESET signal is coupled to configuration register 52, the output enable port of multiplexer 104 and buffer 108. Multiplexer 104 receives outputs from the VRAMs 68 and passes the outputs of a selected bank responsive to a SELECT signal from the video controller 30. Buffer 108 receives a DISPLAY_ID signal.

Upon a RESET signal, the output of multiplexer 104 is disabled and the output of buffer 108 is enabled. Hence, the configuration signals supplied by voltage sources 54 and 56 (through associated resistors as described above in connection with FIG. 4) and the DISPLAY_ID signal are available to the video controller, which latches the signals in the control register 52 upon the falling edge of the RESET signal. When RESET transitions low, the output of multiplexer 104 is enabled to allow communication between the VRAMs 68 and the video controller 30.

As can be seen, the present invention provides significant advantages over the prior art. In particular, configuration signals may be received by the controller responsive to a control signal (such as RESET) on the same nodes used to communicate with other devices external to the controller at other times. Consequently, the pin count of a controller using various configuration signals can be greatly reduced.

Although the present invention and its advantages have been described in detail, it should be understood that various changes, substitutions and alterations can be made herein without departing from the spirit and scope of the invention as defined by the appended claims.

What is claimed is:

1. A control system comprising:

an integrated control circuit having a memory for storing configuration data and one or more common nodes coupled to said memory and to other devices internal to said integrated control circuit;

first and second voltage sources coupled to said common nodes through associated resistive devices for presenting configuration data onto said common nodes; and one or more devices external to said integrated control circuit coupled to said common nodes for communicating external data to said internal devices, wherein the voltage sources present configuration data onto said common nodes concurrently with the external devices communicating external data through said common nodes.

2. The control system of claim 1 wherein said memory includes circuitry for storing configuration data from said first and second voltage sources responsive to a control signal.

3. The control system of claim 2 and further comprising circuitry for decoupling said external devices from said common nodes responsive to said control signal.

4. The control system of claim 3 wherein said control signal is a system reset signal.

5. The control system of claim 1 wherein said memory comprises a register for latching data responsive to a control signal.

6. A video subsystem for use in conjunction with a computer, comprising:

a video controller integrated circuit having a configuration memory for storing configuration data and one or more shared pins coupled to said configuration memory and to other devices internal to said video controller;

first and second voltage sources coupled to said shared pins through associated resistive devices for providing configuration data to said video controller; and one or more devices external to said video controller coupled to said shared pins for communicating with said internal devices such that the voltage sources provide configuration data on said shared pins concurrently as the external devices communicate through said shared pins.

7. The video subsystem of claim 6 wherein said configuration memory includes circuitry for storing configuration data from said first and second voltage sources responsive to a control signal.

8. The video subsystem of claim 7 and further comprising circuitry for decoupling said external devices from said shared pins responsive to said control signal.

9. The video subsystem of claim 8 wherein said control signal is a system reset signal.

10. The video subsystem of claim 6 wherein said configuration memory comprises a register for latching data responsive to a control signal.

11. A method of communicating configuration data to an integrated circuit comprising the steps of:

presenting configuration signals from an external voltage source on a set of shared pins coupled to the integrated circuit responsive to a first state of a control signal; and communicating signals from external devices present on said set of shared pins to devices internal to the integrated circuit concurrently with said step of presenting configuration signals from an external voltage source responsive to a second state of said control signal.

12. The method of claim 11 wherein said step of presenting configuration signals from an external voltage source on a set of shared pins comprises the step of storing signals present on said set of shared pins coupled to the integrated circuit into a configuration memory responsive to a first state of a reset signal.

13. The method of claim 11 wherein said step of presenting configuration signals from an external voltage source on a set of shared pins comprises the step of storing signals present on said set of shared pins coupled to the integrated circuit into a configuration register coupled to a reset signal.

14. The method of claim 13 and wherein said step of communicating signals from external devices present on said set of shared pins comprises the step of communicating signals on said set of shared pins to devices internal to the integrated circuit responsive to a reset signal.

15. A control system, comprising:

voltage sources coupled to associated resistive devices for providing configuration data;

one or more external devices for communicating external data;

an integrated control circuit, including:

a memory for storing configuration data;

internal devices for processing external data; and a set of shared pins coupled to said voltage sources through said associated resistive devices and coupled to said one or more external devices such that the voltage sources provide configuration data on said set of shared pins and the external devices concurrently communicate to said internal devices through said set of shared pins.

16. The control system of claim 15 wherein the voltage sources communicate to said memory through said set of shared pins responsive to a control signal.

17. The control system of claim 16 further including circuitry for decoupling said external devices from said set of shared pins responsive to said control signal.

18. The control system of claim 17 wherein said control signal is a system reset signal.

19. The control system of claim 15 wherein said memory comprises a register for latching configuration data responsive to a control signal.

* * * * *

UNITED STATES PATENT AND TRADEMARK OFFICE

CERTIFICATE OF CORRECTION

PATENT NO : 5,670,983

DATED : September 23, 1997

INVENTOR(S): Abdel Hamid Suboh, Patrick A. Harkin, Stuart Hecht

It is certified that error appears in the above-identified patent and that said Letters Patent is hereby corrected as shown below:

Col. 3, ln. 15, delete "(i.e,", insert -- (i.e., --.

Col. 3, ln. 42, delete "low Logic level", insert -- low logic level --.

Col. 4, ln. 20, delete "Patent application", insert -- Patent Application --.

Signed and Sealed this

Second Day of December, 1997

*Attest:*

*Attesting Officer*

Bruce Lehman

BRUCE LEHMAN

*Commissioner of Patents and Trademarks*